US012276068B2

(12) United States Patent
Boeck

(10) Patent No.: US 12,276,068 B2
(45) Date of Patent: Apr. 15, 2025

(54) FABRIC TAPE

(71) Applicant: Voith Patent GmbH, Heidenheim (DE)

(72) Inventor: Johann Boeck, Fornach (AT)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 18/218,071

(22) Filed: Jul. 4, 2023

(65) Prior Publication Data

US 2024/0018718 A1 Jan. 18, 2024

(30) Foreign Application Priority Data

Jul. 12, 2022 (DE) ..... DE102022117305.4

(51) Int. Cl.
*D21F 7/08* (2006.01)
*D03D 3/04* (2006.01)
*D21F 1/00* (2006.01)

(52) U.S. Cl.
CPC ..... *D21F 1/0036* (2013.01); *D03D 3/04* (2013.01)

(58) Field of Classification Search
CPC ..... D21F 1/0036; D21F 7/083; D21F 1/105; D03D 3/04; D03D 11/00; D03D 1/0094; D03D 13/004
See application file for complete search history.

(56) References Cited

U.S. PATENT DOCUMENTS 4,333,502 A * 6/1982 Karm ..... D21F 1/0036 162/903
4,776,373 A * 10/1988 Borel ..... D21F 1/0036 162/DIG. 4
4,934,414 A * 6/1990 Borel ..... D21F 1/0036 162/903
5,152,326 A * 10/1992 Vohringer ..... D21F 1/0045 139/410
7,025,095 B2 * 4/2006 Zils ..... D21F 1/0036 139/408
7,503,351 B2 * 3/2009 Hack-Ueberall ..... D21F 1/0036 162/348
7,717,141 B1 * 5/2010 Quigley ..... D21F 1/0036 139/383 R (Continued)

FOREIGN PATENT DOCUMENTS

DE 102012207044 A1 10/2013
WO WO2013160391 A1 10/2013

*Primary Examiner* — Robert H Muromoto, Jr.
(74) *Attorney, Agent, or Firm* — Von Rohrscheidt Patents

(57) ABSTRACT

A forming fabric tape for a machine for producing or processing a fiber material web, the forming fabric tape including an upper fabric layer including upper longitudinal threads and upper transversal threads woven into the upper longitudinal threads; and a lower fabric layer including lower longitudinal threads and lower transversal threads woven into the lower longitudinal threads, wherein the upper fabric layer and the lower fabric layer are arranged on top of one another so that the upper fabric layer is oriented towards the fiber material web and the lower fabric layer is oriented away from the fiber material web, wherein the upper longitudinal threads are offset from each other unevenly, wherein the upper longitudinal threads are arranged so that average distances of the upper longitudinal threads have the following sequence which is repeated continuously in the transversal direction of the fabric tape: large distance, large distance, small distance.

14 Claims, 2 Drawing Sheets

(56) References Cited

U.S. PATENT DOCUMENTS

| | | | | |
|---|---|---|---|---|
| 11,339,534 | B2 * | 5/2022 | Gleich | D21F 7/083 |
| 12,000,089 | B2 * | 6/2024 | Gleich | D03D 1/00 |
| 2015/0075743 | A1 * | 3/2015 | Boeck | D21F 1/0036<br>162/348 |
| 2015/0090417 | A1 * | 4/2015 | Boeck | D21F 1/0045<br>162/348 |
| 2024/0018700 | A1 * | 1/2024 | Boeck | D21F 1/0036 |

* cited by examiner

FABRIC TAPE

RELATED APPLICATIONS

This application claims priority from and incorporates by reference German Patent Application DE 10 2022 117 305.4 filed on Jul. 12, 2022.

FIELD OF THE INVENTION

The invention relates to a fabric tape, in particular a forming fabric for a machine configured to produce and/or process a fiber material web.

BACKGROUND OF THE INVENTION

Generic fabric tapes also designated as SSB (sheet support binding) forming fabrics have been successfully used in the paper and cardboard industry since the middle of the 1990's. The multilayer configuration of the fabric tape has the advantage that the upper longitudinal threads and transversal threads can be configured thinner than the lower longitudinal threads and the lower transversal threads. Thus, the upper longitudinal threads and transversal threads can provide a very fine and smooth surface for the fiber material web, whereas the thicker lower longitudinal threads and transversal threads receive tension forces impacting the webbing in the longitudinal and transversal direction and are configured to resist the wear that the fabric tape is exposed to when it is run in the machine over fixed water extraction elements like e.g. vacuum boxes.

When the fabric tape includes a weave pattern that includes an identical number of upper and lower longitudinal threads typically an upper longitudinal thread is arranged above each lower longitudinal thread. This is also called "on-stacking". The upper and lower longitudinal threads are thus all offset from each other by essentially identical amounts. This weaving pattern has the advantage of a minimum water extraction resistance caused by the longitudinal threads and thus leads to a high quality formation of the fiber material web. However, when the water extraction speed becomes excessive there is a risk that an excessive amount of filler materials is washed out.

In a known alternative weaving pattern, it is provided that the upper longitudinal threads are arranged exactly above the gap between two adjacent lower longitudinal threads. This is then called "off-stacking". Though all upper and lower longitudinal threads are also offset from each other by identical amounts in this case, water exiting from the fiber web, cannot be extracted through the fabric tape in the same straight line. This reduces the water extraction speed and causes less filler materials to be washed out. The reduced water extraction speed, however, can lead to an undesired reduction of the production speed.

Furthermore, fabric tapes in particular provided as SSB forming fabrics are known where the number of the upper longitudinal threads differs from the number of the lower longitudinal threads, in particular the number of the upper longitudinal threads is greater. Thus, the upper longitudinal threads and the upper transversal threads can be configured finer than the lower longitudinal threads and the lower transversal threads in order to provide an even smoother contact surface for the fiber material web. A generic fabric tape is shown, for example, in FIG. 1d of the printed document WO 2013 160391 A1. Thus, the longitudinal threads are arranged in different groups adjacent to one another, namely in first groups which are respectively formed from a lower longitudinal thread and an upper longitudinal thread arranged there above and second groups respectively formed from a lower longitudinal thread and two upper longitudinal threads arranged there above. In order to minimize undesirable hydraulic marking properties that are primarily caused by the lower longitudinal threads, the lower longitudinal threads are essentially offset from each other by identical distances. This however has the effect that the upper longitudinal threads are spaced differently from each other which is less than optimum with respect to the topographic marking properties of the fabric tape. On the flip side, however, the advantages of the "on-stacking" and "off-stacking" can be combined with each other.

BRIEF SUMMARY OF THE INVENTION

Thus, it is an object of the instant invention to further improve marking properties of the fabric tape described supra. The intent is to further improve a generic fabric tape so that it retains its low hydraulic marking properties and to combine the advantages of "on-stacking" and "off-stacking" while simultaneously optimizing its topographic marking properties.

The object is achieved by a forming fabric tape for a machine for producing or processing a fiber material web, the forming fabric tape comprising: an upper fabric layer including upper longitudinal threads and upper transversal threads woven into the upper longitudinal threads; and a lower fabric layer including lower longitudinal threads and lower transversal threads woven into the lower longitudinal threads, wherein the upper fabric layer and the lower fabric layer are arranged on top of one another so that the upper fabric layer is oriented towards the fiber material web and the lower fabric layer is oriented away from the fiber material web, wherein the upper longitudinal threads are offset from each other unevenly, wherein the upper longitudinal threads are arranged so that average distances of the upper longitudinal threads have the following sequence which is repeated continuously in the transversal direction of the fabric tape: large distance, large distance, small distance, and wherein a difference between an average large distance and an average small distance is at least 50% of a diameter of an upper longitudinal thread. Further advantageous features are recited in the following paragraph.

The large distance may be between 100% and 300% of the diameter of the upper longitudinal thread or the small distance may be between 30% and 125% of the diameter of the upper longitudinal thread. A ratio of upper warp threads to lower warp threads in the fabric tape may be 1:1, and the lower warp threads may be spaced identically from each other. A weave pattern of the forming fabric tape may be repeated in pattern repeats, and the upper longitudinal threads and the lower longitudinal threads may be arranged in each pattern repeat in plural groups including a first group and a second group and at least one additional first group or second group. Each first group is formed respectively from an upper longitudinal thread and a lower longitudinal thread arranged below the upper longitudinal thread and each second group is formed respectively from an upper longitudinal thread and two lower longitudinal threads arranged below the upper longitudinal thread. The two lower longitudinal threads of a second group may have the second distance from each other while the two lower longitudinal threads of a first group and a second group directly adjacent to the first group or the two lower longitudinal threads of two directly adjacent first groups may have the first distance from each other. A weaving pattern of the fabric tape may be repeated in repeat units. The upper longitudinal threads and the lower longitudinal threads in each repeat unit may be arranged in plural groups including a first group and a second group. The first group may be formed from an upper longitudinal thread and a lower longitudinal thread arranged below the upper longitudinal thread and the second group may be formed from two upper longitudinal threads and one lower longitudinal thread arranged below the upper longitudinal threads. A first distance between two directly adjacent lower longitudinal threads may be greater than a second distance between two directly adjacent lower longitudinal threads, and the difference between the first distance and the second distance may be between 25% and 200% of the diameter of the upper longitudinal thread. The difference between the average large distance of two directly adjacent upper longitudinal threads and the average small distance between two directly adjacent longitudinal threads may be 200% at the most or 150% at the most of the diameter of the upper longitudinal thread. The first and the second fabric layer may be connected with each other through binding threads arranged in pairs. The binding threads may extend in a direction of the transversal threads. The two binding threads of a respective binding thread pair may be woven in an alternating pattern with upper and lower longitudinal threads and cross over in cross over points when alternating between being woven with the upper longitudinal threads and the lower longitudinal threads and vice versa. Each binding thread pair may provide at least two intersection points per pattern repeat. The upper fabric layer may be formed by weaving the upper longitudinal threads with the upper transversal threads and the binding threads and the lower fabric layer is formed by weaving the lower longitudinal threads with the lower transversal threads. The upper fabric layer may form a plain weave.

The fabric tape according to the invention is characterized in that the upper longitudinal threads are arranged so that their average distances have the following sequence which is continuously repeated in the transversal direction of the fabric tape, distance, small distance, wherein the difference between an average large distance and an average small distance is at least 50% of a diameter of an upper longitudinal thread.

Surprisingly the inventors have found that this sequence of distances of the upper longitudinal threads is very advantageous for the markings in the fiber material web. Though not all upper longitudinal threads are offset from each other identically, topographic markings caused by this pattern are hardly detectable or not detectable at all in the fiber material web. Instead, the different distances of the upper longitudinal threads advantageously help to mask hydraulic diagonal markings that are caused by the weaving pattern of the lower fabric layer. This way the fabric tape according to the invention facilitates producing fiber material webs with excellent quality through uniform formation.

In particular with SSB forming fabrics it can occur that the upper longitudinal threads do not run completely straight in the longitudinal direction of the fabric tape but perform a wave action to the left and to the right, this means to side edges of the fabric tape. This wave action is caused by the binding threads, when they are transversal threads they press the upper longitudinal threads to the right and to the left depending on which side of the upper longitudinal thread they run downward. Therefore, the distance between two upper longitudinal threads is not necessarily constant viewed in the longitudinal direction of the webbing. In view of this fact, the instant application specifies the "average" distance of two adjacent longitudinal threads. Put differently, a longitudinal thread extending in a straight line shall be presumed when the distance in the longitudinal direction of the fabric tape varies, in particular when a wave line is provided and the straight-line longitudinal thread is presumed to be arranged on a center line of the wave line. This "average" distance of the upper longitudinal threads is adjustable during the production process of the fabric tape. Typically, these fabric tapes are woven flat, thermally fixed and subsequently closed into a continuous belt on a splicing machine using a spliced seam. When performing flat weaving, the longitudinal threads correspond to the warp threads and the transversal threads correspond to the weft threads. The distance of the warp threads is adjustable in the so-called weaving reed.

Furthermore, the average distance values of the two large distances may not be exactly identical. The average value of the first large distance of the sequence described supra of: large distance, large distance, small distance can be slightly smaller or slightly greater than an average value of the second large distance. If this is the case, it shall hold at least for the large distance that has the greater average distance value that the difference between the average large distance and the average small distance is at least 50% of a diameter of an upper longitudinal thread. For the other large distance that has the smaller average distance value, it shall advantageously hold that the difference between the average large distance and the average small distance is at least 20% of a diameter of an upper longitudinal thread.

Like in most fabric tapes, all longitudinal threads in the instant embodiment advantageously have the same cross-sectional shape with the same diameter. If this cross-sectional shape is not circular but, for example, flattened the diameter is a diameter of a circular cross section that has the same cross-sectional area. This also applies accordingly to the lower longitudinal threads.

In a thermal fixing process which has to be applied to a forming fabric application for flat woven fabric tape in order to facilitate a subsequent spliced seam forming is performed at an increase temperature under tension load, in particular a plastic deformation of the warp threads originally used as stretched straight mono filaments in the longitudinal direction at intersection points with the weft threads originally provided in the transversal direction as stretched straight monofilaments.

Since in particular the warp threads are provided with a tension load in the thermal fixing process, the warp threads flatten slightly under temperature impact and the tension load. When the instant application refers to circular cross-sectional shapes of the warp threads this flattening and the coinciding deviation from the circular shape is disregarded. Instead, a circular cross-sectional shape with an equivalent cross-sectional surface is used as a base line.

In order to provide the smoothest surface possible for the fiber material web, the upper longitudinal threads have a smaller diameter than the lower longitudinal threads. In particular, the diameter of the upper longitudinal threads can merely be between 40% and 60% of the diameter of the lower longitudinal threads. The diameter of the upper longitudinal threads can be, for example, between 0.07 mm and 0.30 mm and/or the diameter of the lower longitudinal threads can be between 0.15 mm and 0.50 mm.

Advantageously the large distance is between 100% and 300% of a diameter of an upper longitudinal thread and/or the small distance is between 30% and 125% of a diameter of an upper longitudinal thread. These values have produced very satisfactory results with respect to formation of the fiber material web. Even when the distance between two directly adjacent upper longitudinal threads in the longitudinal direction of the fabric tape is not constant, but the upper longitudinal thread follows a wave line, the first and/or the second distance advantageously always are in the range or in the ranges recited supra.

A first embodiment of the fabric tape according to the invention, provides that a ratio of upper warp threads to lower warp threads in the fabric tape is 1:1, wherein the lower warp threads are advantageously spaced identically from each other. Thus, for example, a group of longitudinal threads including a lower longitudinal thread and an upper longitudinal thread arranged exactly above the lower longitudinal thread (on-stacked) can be adjacent to a group of longitudinal threads which consists of a lower longitudinal thread and an upper longitudinal thread which is not arranged exactly above the lower longitudinal thread (off-stacked).

A second alternative embodiment of the fabric tape according to the invention provides that the weaving pattern of the fabric tape is repeated in pattern repeats wherein the upper longitudinal threads and the lower longitudinal threads in each pattern repeat are arranged in several groups including a first group and a second group and at least one additional first group and/or second group, wherein each first group is formed from an upper longitudinal thread and a lower longitudinal thread arranged below the upper longitudinal thread and each second group is respectively formed from an upper longitudinal thread and two lower longitudinal threads arranged below the upper longitudinal thread. Advantageously the longitudinal threads of the fabric tape consist of such first and second groups. Advantageously the upper and lower longitudinal threads in each group are not offset relative to each other or offset only slightly relative to each other in an orthogonal view upon the fabric layers so that a clear space of a half-diameter of an upper longitudinal thread is provided at the most between the upper longitudinal threads and the lower longitudinal threads of each group. Advantageously the quotient of the number of upper longitudinal threads divided by the number of lower longitudinal threads is not an integer. A pattern repeat can thus include one or plural repeat units, this means a fixed sequence of first and second groups of longitudinal threads, wherein a group repeat sequence should advantageously not exceed 15.

In addition to the uneven spacing of the upper longitudinal threads according to the invention advantageously also an uneven spacing of the lower longitudinal threads can be advantageous. It can be provided in particular that a first distance between two directly adjacent lower longitudinal threads is greater than a second distance between directly adjacent lower longitudinal threads wherein the difference between the first distance and the second distance is between 25% and 200% of a diameter of an upper longitudinal thread. Surprisingly the inventors have found that it can be advantageous with respect to hydraulic marking properties of the fabric tape, contrary to popular opinion, that the lower longitudinal threads are not always arranged with identical distances from each other. The inventors explain this observation with a substantial portion of the hydraulic marking properties being caused by repetitive hydraulic diagonal markings which are significantly reduced by lower longitudinal threads that can be arranged at non-uniform distances from each other. The non-uniform spacing of the lower longitudinal threads synergistically cooperates with the non-uniform spacing of the upper longitudinal threads according to the invention to mask or prevent uniform hydraulic diagonal markings that are primarily caused by the weaving pattern of the lower fabric layer.

Thus, it can be provided that the two lower longitudinal threads of a second group have the second distance from each other whereas the two lower longitudinal threads of a first group and a second group directly adjacent to the first group and/or the two lower longitudinal threads of two directly adjacent first groups have the first distance from each other.

According to a third advantageous embodiment of the fabric tape according to the invention the weaving pattern of the fabric tape is repeated in pattern repeats wherein the upper longitudinal threads and the lower longitudinal threads are arranged in several groups in each pattern repeat including a first group and a second group, wherein the first group is formed from an upper longitudinal thread and a lower longitudinal thread arranged below the upper longitudinal thread and the second group is also formed from two upper longitudinal threads and a lower longitudinal thread arranged below the upper longitudinal threads. Advantageously the longitudinal threads of the fabric tape are exclusively included in such first and second groups. Advantageously the pattern repeat includes the same number of first groups and second groups. Furthermore, the upper and lower longitudinal threads in each group cannot be offset relative to each other at all or only slightly offset relative to each other in each group in an orthogonal view of the fabric layers, so that a free space of half a diameter of an upper longitudinal thread is provided at the most between the upper longitudinal threads and the lower longitudinal threads of each group. Advantageously the quotient of the number of the upper longitudinal threads divided by the number of the lower longitudinal threads is not an integer. A pattern repeat can include one or plural repeat units, this means a fixed sequence of first and second groups of longitudinal threads wherein the group repeat sequence should not exceed 15.

It has furthermore proven advantageous when a difference between an average large distance of two directly adjacent upper longitudinal threads and an average small distance between two directly adjacent upper longitudinal threads is 200% at the most, advantageously 150% at the most of a diameter of an upper longitudinal thread. When the differences are too large there is a risk that this can still cause optically perceivable topographic markings in the fiber material web.

As described supra with respect to known SSB forming fabrics it is advantageously provided according to the invention that the first and the second fabric layer are connected with each other by binding threads arranged in pairs. These binding threads can extend in the transversal direction of the fabric tape. Furthermore, the two binding threads of the respective binding thread pair can be woven in an alternating pattern with upper and lower longitudinal threads and can cross over in advantageously at least two cross over points when woven with the upper longitudinal threads and the lower longitudinal threads and vice versa.

Advantageously the upper fabric layer is formed by weaving the upper longitudinal threads with the upper transversal threads and the binding threads wherein the lower fabric layer is formed by weaving the lower longitudinal threads with the lower transversal threads. This means that the binding threads are an integral part of the upper fabric layer and do not contribute to the lower fabric layer but merely connect the lower fabric layer with the upper fabric layer.

According to an advantageous embodiment of the invention the weaving pattern of the upper fabric layer, is provided in plain weave. Plain weave is particularly uniform having the smallest possible repeat unit. Differently from other bindings the plain weave has no binding ridges that extend in the diagonal direction. Therefore, the plain weave of the upper fabric layer does not cause the hydraulic diagonal marking caused by the lower fabric layer.

BRIEF DESCRIPTION OF THE DRAWINGS

The invention is subsequently described based on advantageous embodiments with reference to drawing figures, wherein.

DETAILED DESCRIPTION OF THE INVENTION

Figure 1:
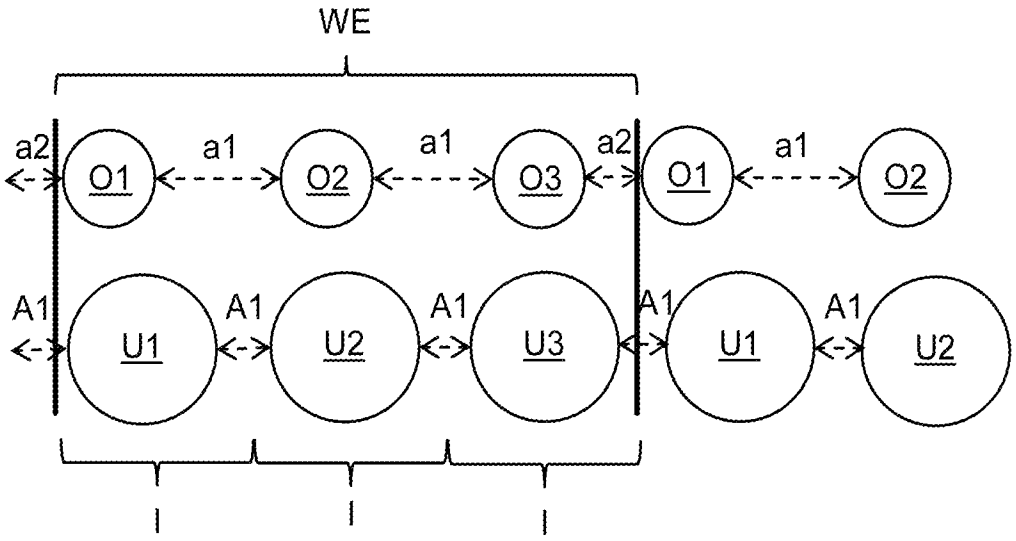
FIG. 1 illustrates a schematic view of a first embodiment of a fabric tape according to the invention.

FIG. 1 schematically illustrates a first embodiment of a fabric tape according to the invention showing only the upper longitudinal threads O1-O3 and the lower longitudinal threads U1-U3 forming a repeat unit WE in combination but not showing upper transversal threads which are woven with the upper longitudinal threads O1-O3 to form an upper fabric layer, lower transversal threads which are woven with the lower longitudinal threads U1-U3 to form a lower fabric layer and binding threads which connect the upper fabric layer with the lower fabric layer. Thus, the binding threads advantageously are an integral component of the weave, in particular of a linen weave of the upper fabric layer, whereas the binding threads do not contribute to the weave of the lower fabric layer.

The fabric tape is composed of recurring pattern repeats. With respect to the upper longitudinal threads O1-O3 and the lower longitudinal threads U1-U3 a pattern repeat can include exactly one repeat unit WE. Quite frequently, however, a pattern repeat includes plural repeat units WE. It is appreciated that a pattern repeat is not only defined by the longitudinal threads, but also by the transversal threads and the binding threads. When the outer fabric layer is advantageously configured in plain weave, the pattern repeat has to include an even number of upper longitudinal threads. Since the repeat unit WE in the first embodiment according to FIG. 1 includes three upper longitudinal threads O1-O3, the pattern repeat has to include an integer multiple of the repeat units WE, thus at least two repeat units WE.

In the instant first embodiment a repeat unit WE is formed from three groups of longitudinal threads, namely three first groups I respectively including only an upper longitudinal thread O1-O3 and a lower longitudinal thread U1-U3. A first relatively large distance a1 is provided between the first upper longitudinal thread O1 and the second upper longitudinal thread O2. The same relatively large distance a1 is also provided between the second upper longitudinal thread O2 the adjacent third upper longitudinal thread O3. Accordingly, the distance a2 between the third upper longitudinal thread O3 and the adjacent upper longitudinal thread O1 of a next repeat unit is significantly smaller. This yields a sequence of the distances of the upper longitudinal threads O1-O3 in the transversal direction of the fabric tape of large distance a1, large distance a1, small distance a2 and this sequence is continuously repeated in the transversal direction. According to the invention the difference between the average large distance a1 and the average small distance a2 is at least 50% of the diameter of the upper longitudinal threads O1-O3. In the illustrated embodiment all upper longitudinal threads have the same circular cross section, whereas all lower longitudinal threads have the same circular second cross section. Furthermore, the two large distances a1 have the same average value in the instant embodiment. This, however, is not mandatory.

In this first embodiment, the lower longitudinal threads U1-U3 essentially all have the same distance A1 from each other.

Figure 2:
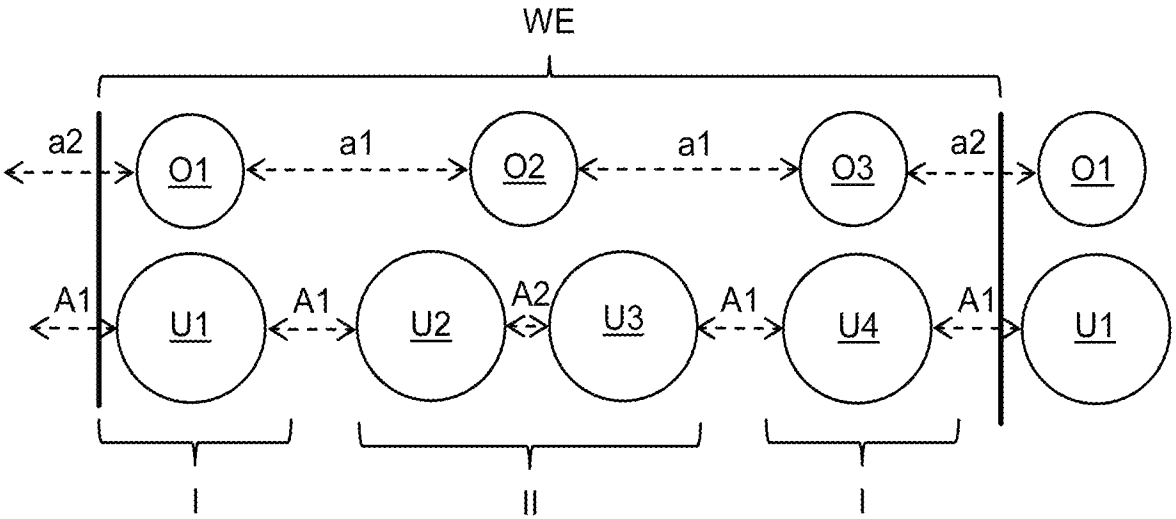
FIG. 2 illustrates a schematic view of a second embodiment of a fabric tape according to the invention.

FIG. 2 schematically illustrates a second embodiment of a fabric tape according to the invention showing only the upper longitudinal threads O1-O3 and the lower longitudinal threads U1-U4, forming a repeat unit WE in combination, but not showing the upper transversal threads which are woven with the upper longitudinal threads O1-O3 to form an upper fabric layer, lower transversal threads woven with the upper longitudinal threads U1-U4 to form a lower fabric layer and binding threads which connect the upper fabric layer with the lower fabric layer. Thus, the binding threads are advantageously configured as an integral component of the weave, in particular of a plain weave of the upper fabric layer, whereas they do not contribute to the weave of the lower fabric layer.

Also this fabric tape is assembled from recurring pattern repeats. With respect to the upper longitudinal threads O1-O3 and the lower longitudinal threads U1-U4 a pattern repeat can be made in principle from exactly one repeat unit WE. Frequently, however, a pattern repeat includes plural repeat units WE. It is appreciated that a pattern repeat is not only defined by the longitudinal threads but also by the transversal threads or binding threads. When the upper fabric layer is advantageously provided as plain weave, a pattern repeat has to include an integer number of upper longitudinal threads. Since the repeat unit WE includes three upper longitudinal threads O1-O3 also in the second embodiment according to FIG. 2, the pattern repeat has to include an integer multiple of the repeat units WE, thus at least 2 repeat units WE.

In the instant second embodiment, a repeat unit WE is formed from three groups of longitudinal threads, namely a first group I including only an upper longitudinal thread O1 and a lower longitudinal thread U1, a second group including an upper longitudinal thread O2 and two lower longitudinal threads U2 and U3, and an additional first group I including only an upper longitudinal threads O3 and a lower longitudinal thread U4. A first relatively large distance a1 is provided between the first upper longitudinal thread O1 and the second upper longitudinal thread O2. The same relatively large distance a1 is also provided between the second upper longitudinal thread O2 and the adjacent third upper longitudinal thread O3. By comparison the distance a2 between the third upper longitudinal thread O3 and the adjacent upper longitudinal thread O1 of a next repeat unit is significantly narrower. This yields a sequence of the distances of the longitudinal threads O1-O3 in the transversal direction of the fabric tape: large distance a1, large distance a1, small distance a2 and this sequence is continuously repeated in the transversal direction. According to the invention the difference between the average large distance a1 and the average small distance a2 is at least 50% of the diameter of the upper longitudinal thread O1-O3.

In this second embodiment the lower longitudinal threads U1-U4 have different distances from each other. A first relatively large distance A1 is provided between the first lower longitudinal thread U1 and the second lower longitudinal thread U2, as well as between the third lower longitudinal thread U3 and the fourth lower longitudinal thread U4, whereas a second relatively small distance A2 is provided between the second lower longitudinal thread U2 and the third lower longitudinal thread U3. The first relatively large distance A1 is also arranged between the fourth lower longitudinal thread U4 and a first lower longitudinal thread U1 of a directly adjacent repeat unit. Thus, a continuously repeating sequence of first distance, second distance, first distance, first distance is provided in this embodiment with respect to spacing of the lower longitudinal threads.

In this embodiment all upper longitudinal threads O1-O3 have identical circular cross sections and all lower longitudinal threads U1-U4 have identical circular cross sections which, however, are greater than the cross sections of the upper longitudinal threads. Furthermore, the two large distances a1, have the same average value in this embodiment for the case of simplicity which, however, is not mandatory. The dimensions in this embodiment can be selected, for example, as follows:

Diameter of upper longitudinal threads O1-O4: 0.14 mm
Diameter of the lower longitudinal threads U1-U3: 0.19 mm
First distance A1: 0.095 mm
First distance A2: 0.049 mm
Distance a1: 0.2645 mm
Distance a2: 0.145 mm This yields a total extension of a repeat unit WE of 1.094 mm. The difference between the first distance A1 and the second distance A2 is 0.046 mm which corresponds to 33% of the diameter of the upper longitudinal threads.

It is appreciated that the distances, in particular the distances a1 and a2 between the upper longitudinal threads O1-O3 do not have to be constant over an entire longitudinal extension of the fabric tape. These distances can also become smaller and larger again. Therefore, the respective average distance is relevant.

Figure 3:
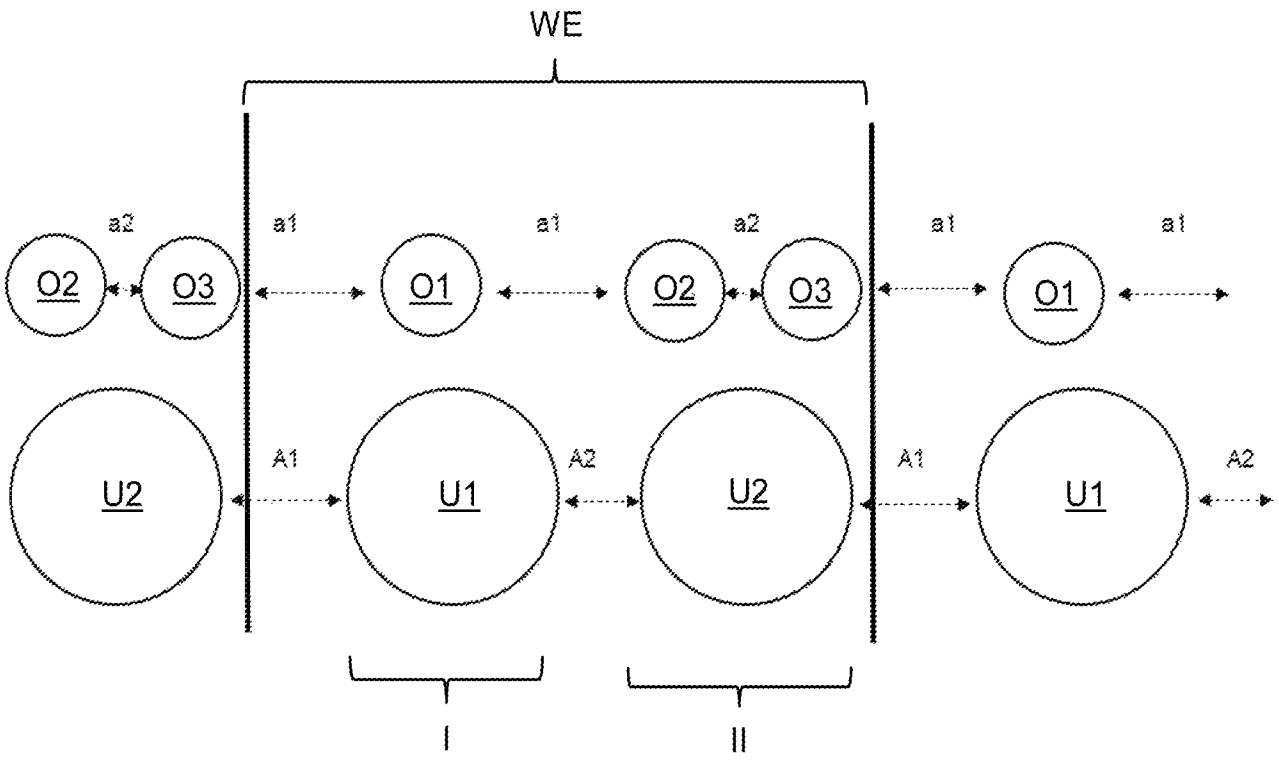
FIG. 3 illustrates a schematic view of a third embodiment of a fabric tape according to the invention.

FIG. 3 schematically illustrates a third embodiment of a fabric tape according to the invention showing only the upper longitudinal threads O1-O3 and the lower longitudinal threads U1-U2, which form a repeat unit WE in combination, but not the upper transversal threads which are woven with the upper longitudinal threads O1-O3 to form an upper fabric layer, lower transversal threads which are woven with the lower longitudinal threads U1-U2 to form a lower fabric layer and binding threads which connect the upper fabric layer with the lower fabric layer. Thus, the binding threads advantageously are an integral component of the weaving pattern, in particular of a plain weave of the upper fabric layer, whereas they do not contribute to the weaving pattern of the lower fabric layer.

Also, this fabric tape, is assembled from recurring pattern repeats. With respect to the upper longitudinal threads O1-O3 and the lower longitudinal threads U1-U2 a pattern repeat can be made from exactly one repeat unit WE. Frequently, however, a pattern repeat includes plural repeat units WE. Thus, it is appreciated that a pattern repeat is not only defined by the longitudinal threads, but also by the transversal threads and binding threads. When the upper fabric layer is advantageously provided in plain weave, a pattern repeat has to include an even number of upper longitudinal threads. Since the repeat unit WE also includes three upper longitudinal threads O1-O3 in the third embodiment according to FIG. 3 the pattern repeat has to include an integer multiple of the repeat units WE, thus at least two repeat units WE.

In the instant third embodiment a repeat unit WE is formed from two groups of longitudinal threads, namely a first group I including only one upper longitudinal thread O1 and a lower longitudinal thread U1 and a second group including two upper longitudinal threads O1 and O3 and a lower longitudinal thread U2. A first relatively large distance a1 is provided between the upper longitudinal thread O1 and the second upper longitudinal thread O2. The same relatively large distance a1 is also provided between the third upper longitudinal thread O3 and an adjacent first upper longitudinal thread O1 of an adjacent repeat unit WE. By comparison, the distance a2 between the second upper longitudinal thread O2 and the adjacent upper longitudinal thread O3 is significantly smaller. This yields a sequence of the distances of the upper longitudinal threads O1-O3 in the transversal direction of the fabric tape: large distance a1, large distance a1, small distance a2, wherein this sequence is continuously repeated in the transversal direction. According to the invention, the difference between the average large distance a1 and the average small distance a2 is at least 50% of the diameter of the upper longitudinal threads O1-O3.

In this third embodiment, the lower longitudinal threads U1 and U2 have different distances from each other. A first relatively large distance A1 is arranged between the second lower longitudinal thread U2 and the first lower longitudinal thread U1 of an adjacent repeat unit WE, whereas a second relatively small distance a1 is arranged between the first lower longitudinal thread U1 and the second lower longitudinal thread U2 within the repeat unit WE.

In this embodiment all upper longitudinal threads O1-O3 have identical circular cross sections and all lower longitudinal threads U1 and U2 have the same circular cross section, which however is greater. Furthermore, the two large distances a1 have the same average value in the instant embodiment for the sake of simplicity which, however, is not mandatory.

What is claimed is:

1. A forming fabric tape for a machine for producing or processing a fiber material web, the forming fabric tape comprising:

an upper fabric layer including upper longitudinal threads and upper transversal threads woven into the upper longitudinal threads; and a lower fabric layer including lower longitudinal threads and lower transversal threads woven into the lower longitudinal threads, wherein the upper fabric layer and the lower fabric layer are arranged on top of one another so that the upper fabric layer is oriented towards the fiber material web and the lower fabric layer is oriented away from the fiber material web, wherein the upper longitudinal threads are offset from each other unevenly, wherein the upper longitudinal threads are arranged so that average distances of the upper longitudinal threads have the following sequence which is repeated continuously in a transversal direction of the fabric tape: first large distance, first large distance, and second small distance, and wherein a difference between an average first large distance and an average second small distance is at least 50% of a diameter of an upper longitudinal thread.

2. The forming fabric tape according to claim 1, wherein the first large distance is between 100% and 300% of the diameter of the upper longitudinal thread or the second small distance is between 30% and 125% of the diameter of the upper longitudinal thread.

3. The forming fabric tape according to claim 1, wherein a ratio of the upper longitudinal threads to the lower longitudinal threads in the fabric tape is 1:1, and wherein the lower longitudinal threads are spaced identically from each other.

4. The forming fabric tape according to claim 1, wherein a weave pattern of the forming fabric tape is repeated in pattern repeats, wherein the upper longitudinal threads and the lower longitudinal threads are arranged in each pattern repeat in plural groups including a first group and a second group and at least one additional first group or second group, and wherein each first group is formed respectively from an upper longitudinal thread and a lower longitudinal thread arranged below the upper longitudinal thread and each second group is formed respectively from an upper longitudinal thread and two lower longitudinal threads arranged below the upper longitudinal thread.

5. The forming fabric tape according to claim 4, wherein the two lower longitudinal threads of a second group have the second small distance from each other while the two lower longitudinal threads of a first group and a second group directly adjacent to the first group or the two lower longitudinal threads of two directly adjacent first groups have the first large distance from each other.

6. The forming fabric tape according to claim 1, wherein a weaving pattern of the fabric tape is repeated in repeat units, wherein the upper longitudinal threads and the lower longitudinal threads in each repeat unit are arranged in plural groups including a first group and a second group, and wherein the first group is formed from an upper longitudinal thread and a lower longitudinal thread arranged below the upper longitudinal thread and the second group is formed from two upper longitudinal threads and one lower longitudinal thread arranged below the upper longitudinal threads.

7. The forming fabric tape according to claim 4, wherein a first large distance between two directly adjacent lower longitudinal threads is greater than a second small distance between two directly adjacent lower longitudinal threads, and wherein a difference between the first large distance and the second small distance is between 25% and 200% of the diameter of the upper longitudinal thread.

8. The forming fabric tape according to claim 1, wherein a difference between the average large distance of two directly adjacent upper longitudinal threads and the average small distance between two directly adjacent longitudinal threads is 200% at the most or 150% at the most of the diameter of the upper longitudinal thread.

9. The forming fabric tape according to claim 1, wherein the upper and the lower fabric layer are connected with each other through binding threads arranged in pairs.

10. The forming fabric tape according to claim 9, wherein the binding threads extend in a direction of the transversal threads.

11. The forming fabric tape according to claim 9, wherein the two binding threads of a respective binding thread pair are woven in an alternating pattern with upper and lower longitudinal threads and cross over in cross over points when alternating between being woven with the upper longitudinal threads and the lower longitudinal threads and vice versa.

12. The forming fabric tape according to claim 11, wherein each binding thread pair provides at least two intersection points per pattern repeat.

13. The forming fabric tape according to claim 9, wherein the upper fabric layer is formed by weaving the upper longitudinal threads with the upper transversal threads and the binding threads and the lower fabric layer is formed by weaving the lower longitudinal threads with the lower transversal threads.

14. The forming fabric tape according to claim 1, wherein the upper fabric layer forms a plain weave.

* * * * *